US009820060B2

(12) United States Patent
Jeong et al.

(10) Patent No.: US 9,820,060 B2
(45) Date of Patent: Nov. 14, 2017

(54) APPARATUS AND METHOD FOR REDUCING POWER CONSUMPTION IN HEARING AID

(71) Applicant: Samsung Electronics Co., Ltd., Suwon-si, Gyeonggi-do (KR)

(72) Inventors: Seong-Hun Jeong, Seoul (KR); Heon-Chol Kim, Seoul (KR); Jung-Keun Park, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 217 days.

(21) Appl. No.: 14/582,737

(22) Filed: Dec. 24, 2014

(65) Prior Publication Data

US 2015/0201283 A1 Jul. 16, 2015

(30) Foreign Application Priority Data

Jan. 10, 2014 (KR) ..... 10-2014-0003583

(51) Int. Cl.
*H04R 25/00* (2006.01)

(52) U.S. Cl.
CPC ..... *H04R 25/30* (2013.01); *H04R 25/305* (2013.01); *H04R 25/556* (2013.01); *H04R 2225/023* (2013.01); *H04R 2460/03* (2013.01)

(58) Field of Classification Search
CPC ... H04R 25/30; H04R 25/305; H04R 2460/03
USPC ..... 381/312
See application file for complete search history.

(56) References Cited

U.S. PATENT DOCUMENTS

2004/0131214 A1 7/2004 Galler et al.
2004/0196992 A1* 10/2004 Ryan ..... H04R 1/10 381/312
2004/0208333 A1* 10/2004 Cheung ..... H04S 1/00 381/333
2005/0226446 A1* 10/2005 Luo ..... H04R 25/00 381/312
2006/0078141 A1* 4/2006 Jessen ..... H04R 25/402 381/313
2007/0076897 A1* 4/2007 Philipp ..... H04R 1/1041 381/74
2009/0103742 A1* 4/2009 Ribic ..... H04R 25/35 381/60
2011/0150254 A1 6/2011 Solum et al.
2013/0070946 A1 3/2013 Kroman
2013/0195295 A1* 8/2013 van Halteren ..... H04R 25/30 381/312

FOREIGN PATENT DOCUMENTS

EP 0 674 466 A1 9/1995
EP 2 012 557 A2 1/2009
JP 2009-159441 A 7/2009
KR 10-2009-0065793 A 6/2009
WO 2011/159349 A1 12/2011

* cited by examiner

*Primary Examiner* — Katherine Faley
(74) *Attorney, Agent, or Firm* — Jefferson IP Law, LLP

(57) ABSTRACT

An apparatus and method for reducing power consumption in a hearing aid are provided. The apparatus includes the processes of identifying a magnitude of an input sound pressure applied to a microphone of the hearing aid and deciding an operation mode of the hearing aid based on the magnitude of the input sound pressure.

10 Claims, 9 Drawing Sheets

APPARATUS AND METHOD FOR REDUCING POWER CONSUMPTION IN HEARING AID

CROSS-REFERENCE TO RELATED APPLICATION(S)

This application claims the benefit under 35 U.S.C. §119 (a) of a Korean patent application filed on Jan. 10, 2014 in the Korean Intellectual Property Office and assigned Serial number 10-2014-0003583, the entire disclosure of which is hereby incorporated by reference.

TECHNICAL FIELD

The present disclosure relates to an apparatus and method for reducing the power consumption of a hearing aid.

BACKGROUND

As people age, patients may suffer from geriatric issues such as deterioration of senses (e.g., sight, hearing, etc.), and the number of people with hearing difficulty due to misuse of electronic devices is increasing. By using hearing aids, hearing disabled patients can increase acoustic sensitivity caused by deteriorated hearing. For example, the hearing aid is installed in an ear of the hearing disabled patient, adaptively amplifies a sound received (or introduced) through a microphone based on a characteristic of the patient, and outputs the amplified sound through a speaker (or a receiver) to correct the deteriorated hearing of the patient.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an apparatus and method for reducing the power consumption of a hearing aid.

Because a hearing aid is miniaturized to be installed in an ear of a hearing disabled patient to correct the patient's hearing, a battery capacity of the hearing aid can be limited. In accordance to this, the hearing aid reduced power consumption.

Another aspect of the present disclosure is to provide an apparatus and method for reducing power consumption in a hearing aid.

Another aspect of the present disclosure is to provide an apparatus and method for reducing unnecessary power consumption in the hearing aid when worn by the user.

Another aspect of the present disclosure is to provide an apparatus and method for operating in a low power mode in the hearing aid when worn by the user.

Another aspect of the present disclosure is to provide an apparatus and method for reducing unnecessary power consumption in a hearing aid based on a magnitude of a sound signal received through a microphone.

Another aspect of the present disclosure is to provide an apparatus and method for operating in a low power mode in a hearing aid based on a magnitude of a sound signal received through a microphone.

In accordance with an aspect of the present disclosure, a method for managing an operation mode in a hearing aid is provided. The method includes the processes of identifying a magnitude of an input sound pressure applied to a microphone of the hearing aid, and deciding the operation mode of the hearing aid based on the magnitude of the input sound pressure.

In accordance with another aspect of the present disclosure, a method for managing an operation mode in a hearing aid is provided. The method includes the determining when the hearing aid is worn by a user, and determining an operation mode of the hearing aid based on the determination of when the user is wearing the hearing aid.

In accordance with another aspect of the present disclosure, a hearing aid apparatus is provided. The apparatus includes at least one microphone, a speaker, and a processor for determining an operation mode of the hearing aid based on a magnitude of an input sound pressure of the microphone.

In accordance with another aspect of the present disclosure, a hearing aid apparatus is provided. The apparatus includes a first microphone, a speaker, a wear sensing module for determining if the hearing aid is worn by a user, and a processor for deciding an operation mode of the hearing aid based the determination of when the user is wearing the hearing aid.

In accordance with another aspect of the present disclosure, a method for managing an operation mode in a hearing aid is provided. The method includes the processes of identifying a magnitude of an input sound pressure applied to a microphone of the hearing aid, comparing the magnitude of the input sound pressure and an effective sound pressure magnitude, and controlling the hearing aid to operate in a low power mode based on the comparison result.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Below, the present disclosure describes a technology for reducing power consumption in a hearing aid.

Below, various embodiments of the present disclosure describe a hearing aid by way of an example, but can be identically applied to a sound output device such as a headphones, a head-set, an earphone, an ear-set, and an earbud, which is powered via a battery and provides sound to an ear of a user.

Figure 1A:
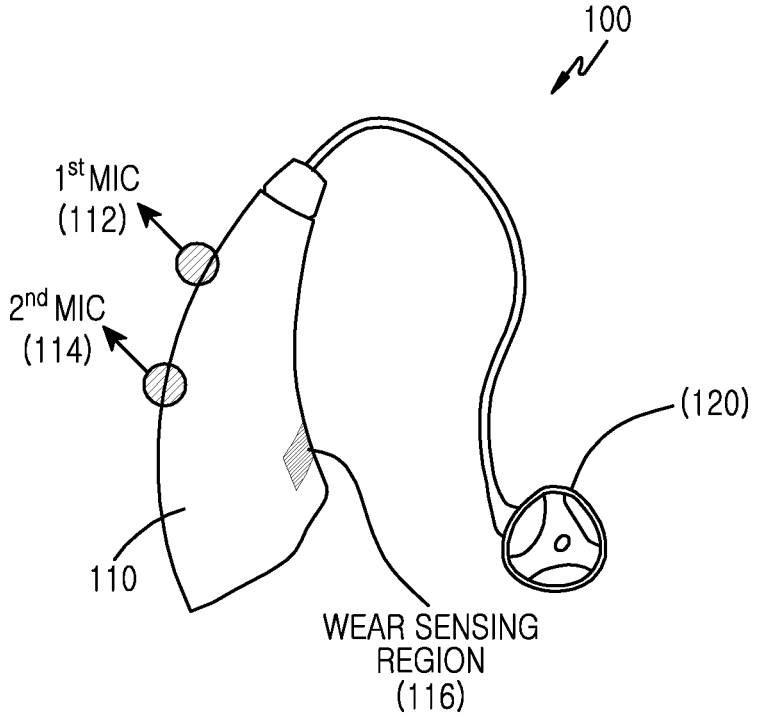
FIGS. 1A and 1B illustrate a hearing aid according to embodiments of the present disclosure.
Figure 1B:
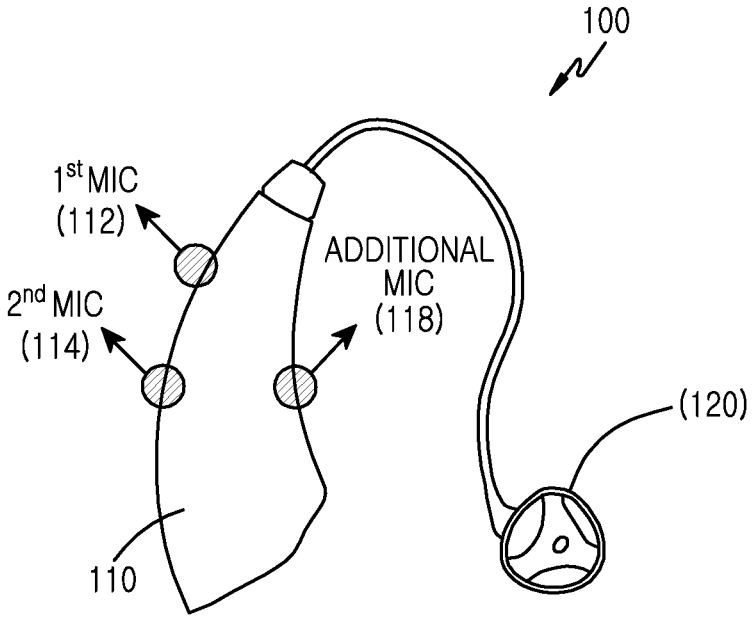

Below, various embodiments of the present disclosure describe, for example, a Receiver In the Canal (RIC) type digital hearing aid as illustrated in FIGS. 1A and 1B below, but can be applied even to other types of digital hearing aids and analog hearing aids worn by a user, such as Completely In the Canal (CIC) type of hearing aids.

FIGS. 1A and 1B illustrate a hearing aid according to an embodiment of the present disclosure.

Referring to FIGS. 1A and 1B, the hearing aid 100 may include a body 110 that is fixed to be adjacent to an ear of a user. The hearing aid receives an external sound or acoustic signal, amplifies the collected sound, and a speaker (or a receiver) 120 located inside an external auditory canal of the user outputs the amplified sound for the user.

In FIG. 1A, the body 110 can include a first microphone 112 and a second microphone 114 for collecting an external sound in different locations of a first surface not coming in contact with the user, and include a wear sensing region 116 for sense when the user is wearing the hearing aid 100 in a second surface that contacts the user. For example, the hearing aid 100 can recognize a capacitance variation or coupling path sensed through the wear sensing region 116 and detect when the hearing aid 100 is worn by the user.

In FIG. 1B, the body 110 can include a first microphone 112 and a second microphone 114 collecting an external sound in different locations of a first surface not contacting the user, and include a third microphone 118 for sensing when the user is wearing the hearing aid 100 if a second surface contacts the user. For example, the hearing aid 100 can compare a magnitude of a first sound signal collected through one or more microphones (e.g., first the microphone 112 and/or the second microphone 114) with a magnitude of a second sound signal collected through a third microphone 118 and detect when the hearing aid 100 is worn by the user. For instance, if the magnitude of the second sound signal is less than the magnitude of the first sound signal by a reference value or more, the hearing aid 100 can recognize that the hearing aid 100 is being worn by the user.

Figure 2:
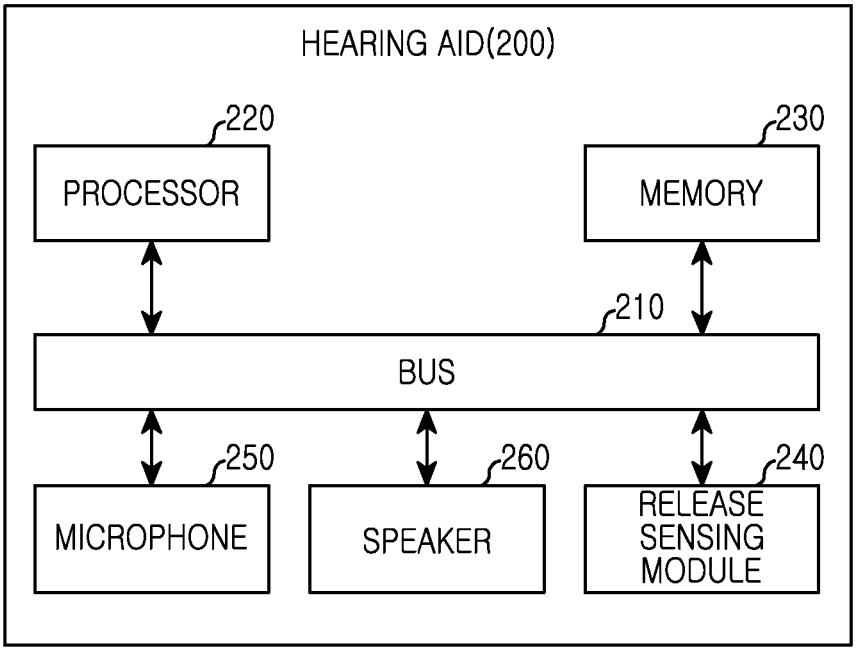
FIG. 2 is a block diagram illustrating a hearing aid according to an embodiment of the present disclosure.

FIG. 2 is a block diagram illustrating a hearing aid according to an embodiment of the present disclosure.

Referring to FIG. 2, the hearing aid 200 includes a bus 210, a processor 220, a memory 230, a release sensing module 240, a microphone 250, and a speaker 260. Here, the speaker 260 can include a receiver.

The bus 210 connects the elements included in the hearing aid 200 with one another and controls communication between the elements included in the hearing aid 200.

The processor 220 can amplify a sound signal collected through the microphone 250 and output the amplified signal through the speaker 260. For example, the processor 220 can receive an audio signal provided from the microphone 250 and convert the audio signal into a digital sound signal. The processor 220 can perform digital signal processing on the digital sound signal such as noise removal, amplification gain, and non-linear amplification. For instance, the processor 220 can control the speaker 260 to amplify the digital sound signal based on a preset amplification gain and output the amplified sound signal. On the other hand, if the hearing aid 200 includes a hardware amplifier (not shown), the hardware amplifier can amplify the digital sound signal based on the control of the processor 220. The processor 220 can convert the digital sound signal into an analog signal and output the analog signal through the speaker 260.

The processor 220 can control an operation mode of the hearing aid 200. For example, the processor 220 can control the hearing aid 200 to operate in a first low power mode based when the release sensing module 240 detects the user wearing the hearing aid 200. For instance, if the hearing aid 200 is not being worn by a user while a power source is applied to the hearing aid 200, e.g., in a battery insertion state, the processor 220 can control to convert into the first low power mode. If the hearing aid 200 operates in the first low power mode, the processor 220 can activate only the release sensing module 240 to detect when the user wears the hearing aid 200. For instance, if the hearing aid 200 operates in the first low power mode, the hearing aid 200 can deactivate the processor 220, the memory 230, the microphone 250, and the speaker 260.

In another example, the processor 220 can control the hearing aid 200 to operate in a second low power mode based on a magnitude of a sound signal collected through the microphone 250. For instance, if an input sound pressure applied to the microphone 250 is less than an effective sound pressure level, the processor 220 can control to convert into the second low power mode. If the hearing aid 200 operates in the second low power mode, the hearing aid 200 can control to activate the processor 220, the microphone 250, and the release sensing module 240.

The memory 230 stores control data for controlling elements of the hearing aid 200 (i.e., the processor 220, the release sensing module 240, the microphone 250, and the speaker 260). For example, the memory 230 can store an amplification gain for sound signal amplification and an effective sound pressure level for low power mode conversion.

The release sensing module 240 detects whether the hearing aid 200 is being worn by the user. For example, if the hearing aid 200 is constructed as in FIG. 1A, the release sensing module 240 can detect whether the hearing aid 200 is worn by the user based on capacitance variation or coupling path setting information that is sensed through the wear sensing region 116. In another example, if the hearing aid 200 is constructed as in FIG. 1B, the release sensing module 240 can compare a first input sound pressure of one or more microphones (e.g., the first microphone 112 and the second microphone 114) with a second input sound pressure of a third microphone 118 and to determine when the hearing aid 200 is being worn by the user. For instance, if the second input sound pressure is less than the first input sound pressure by a reference value or more, the release sensing module 240 can recognize that the hearing aid 200 is being worn by the user.

The microphone 250 collects an external sound, converts the collected sound into an electrical audio signal, and outputs the audio signal. For example, the microphone 250 can include the plurality of (e.g., microphones 112, 114, and 118), can collect a sound of an audible frequency band or preset specific frequency band, convert the collected sound into an electrical audio signal, and output the audio signal. Additionally, the microphone 250 can include a filter for filtering an audio signal or extracting a signal of an audible band based on a hearing characteristic of the user who wears the hearing aid 200.

The speaker 260 outputs an analog sound signal provided from the processor 220. For example, the speaker 260 can amplify the analog sound signal based on an amplification gain that is set in the processor 220, and output the amplified sound signal.

In the aforementioned embodiment of the present disclosure, the processor 220 can operate in a low power mode within one module.

Figure 3:
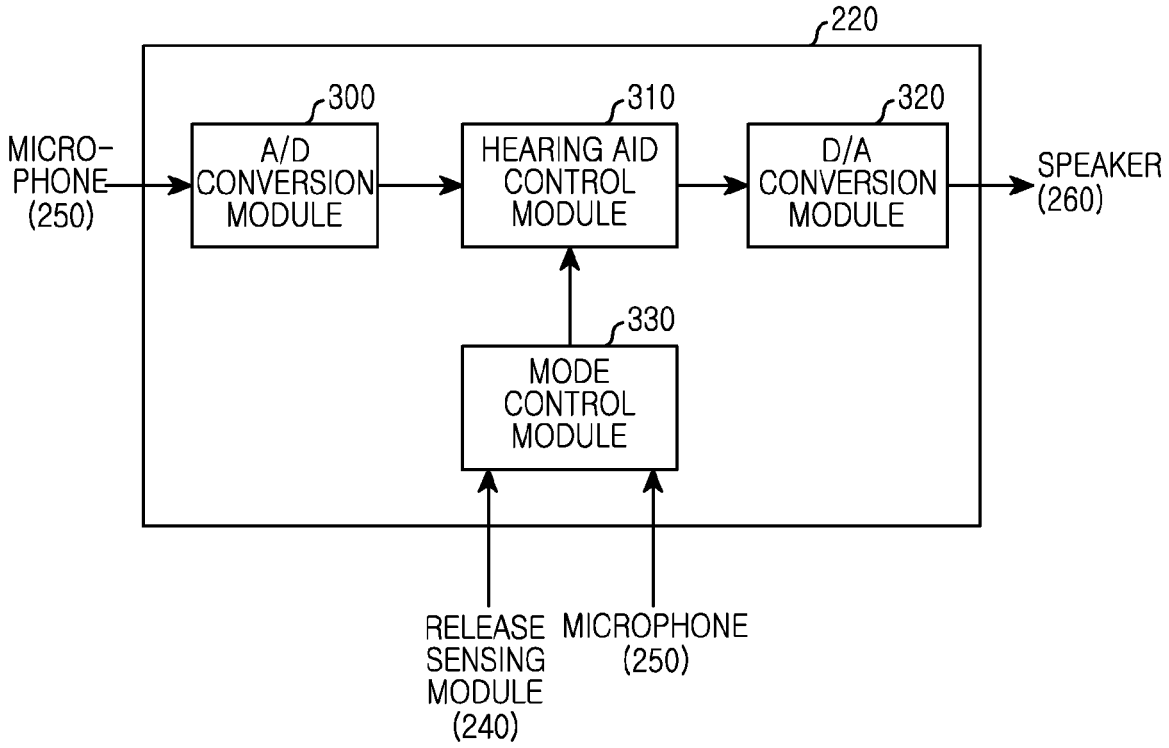
FIG. 3 is a block diagram illustrating a processor according to an embodiment of the present disclosure.

In another embodiment of the present disclosure, the processor 220 can be constructed to include as separate modules for operating in the low power mode as illustrated in FIG. 3 below.

FIG. 3 is a block diagram illustrating a processor according to an embodiment of the present disclosure.

Referring to FIG. 3, the processor 220 includes an Analog-to-Digital (A/D) conversion module 300, a hearing aid control module 310, a Digital-to-Analog (D/A) conversion module 320, and a mode control module 330.

The A/D conversion module 300 may receive and convert an audio signal provided from the microphone 250 into a digital sound signal.

The hearing aid control module 310 can amplify a digital sound signal provided from the A/D conversion module 300. The hearing aid control module 310 can perform digital signal processing such as noise removal, amplification gain, and non-linear amplification on the digital sound signal. For instance, the hearing aid control module 310 can control the speaker 260 to amplify the digital sound signal based on a preset amplification gain and output the amplified sound signal. On the other hand, if the hearing aid 200 includes a hardware amplifier (not shown), the hardware amplifier can amplify the digital sound signal based on the control of the hearing aid control module 310.

The D/A conversion module 320 can convert the digital sound signal, which has been digitally processed (e.g., noise removal, etc.), into an analog signal and output the analog signal through the speaker 260.

The mode control module 330 can control an operation mode of the hearing aid 200. For example, the mode control module 330 can control the hearing aid 200 to operate in a first low power mode based on when the release sensing module 240 detects the user wearing the hearing aid 200. For instance, if the release sensing module 240 detects the user is not wearing the hearing aid while a power source is applied to the hearing aid 200 (e.g., in a battery insertion state, etc.), the mode control module 330 can control to convert into the first low power mode. If the hearing aid 200 operates in the first low power mode, the hearing aid control module 310 can control to activate only the release sensing module 240. For instance, if the hearing aid 200 operates in the first low power mode, the hearing aid control module 310 can control to deactivate the processor 220, the memory 230, the microphone 250, and the speaker 260.

In another example, the mode control module 330 can control the hearing aid 200 to operate in a second low power mode based on a magnitude of a sound signal collected through the microphone 250. For instance, if an input sound pressure of the microphone 250 is less than an effective sound pressure level, the mode control module 330 can control to convert into the second low power mode. If the hearing aid 200 operates in the second low power mode, the hearing aid control module 310 can control to activate the processor 220, the microphone 250, and the release sensing module 240.

In the aforementioned embodiment of the present disclosure, the hearing aid 200 can operate in a low power mode using the processor 220.

In another embodiment of the present disclosure, the hearing aid 200 can also include a separate control module for operating in the low power mode.

Figure 4:
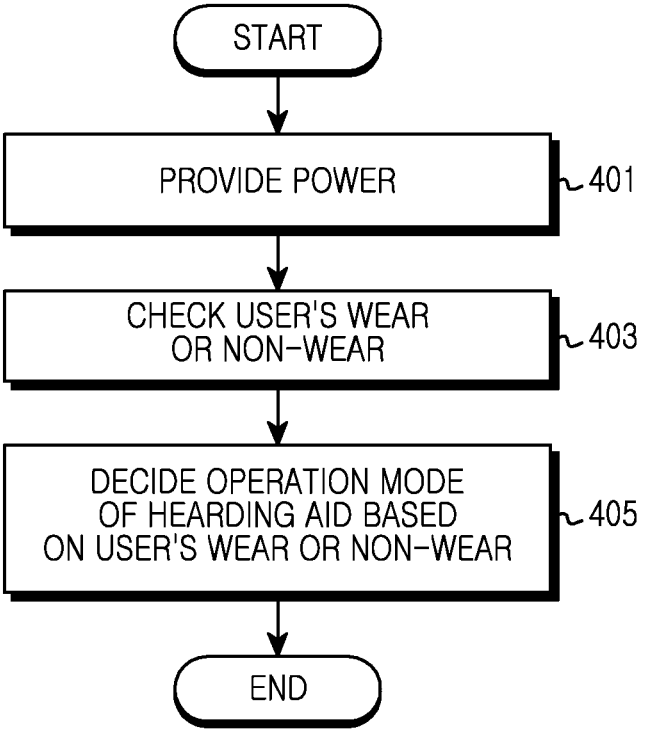
FIG. 4 is a flowchart for deciding an operation mode of a hearing aid according to an embodiment of the present disclosure.

FIG. 4 is a flowchart for deciding an operation mode of a hearing aid according to an embodiment of the present disclosure.

Referring to FIG. 4, at operation 401, the hearing aid checks if a power source is provided. For example, the hearing aid can check if a battery is inserted.

At operation 403, the hearing aid checks whether the hearing aid is worn by a user. For example, referring to FIG. 1A, the hearing aid 100 can check whether the hearing aid 200 is worn by the user based on capacitance variation or coupling path setting information that is sensed via the wear sensing region 116. In another example, referring to FIG. 1B, the hearing aid 100 can compare a first input sound pressure of one or more microphones among the first microphone 112 and the second microphone 114 with a second input sound pressure of a third microphone 118 and determine whether the hearing aid 200 is worn by the user.

At operation 405, the hearing aid decides an operation mode of the hearing aid based on whether the hearing aid is worn by the user. For example, if the hearing aid is not worn by the user, the hearing aid can decide the operation mode of the hearing aid as a low power mode. However, if the hearing aid is worn by the user, the hearing aid can decide the operation mode of the hearing aid as a normal mode. Here, the normal mode can represent a general operation of amplifying a sound signal received through a microphone and outputting the amplified sound signal in the hearing aid.

Figure 5:
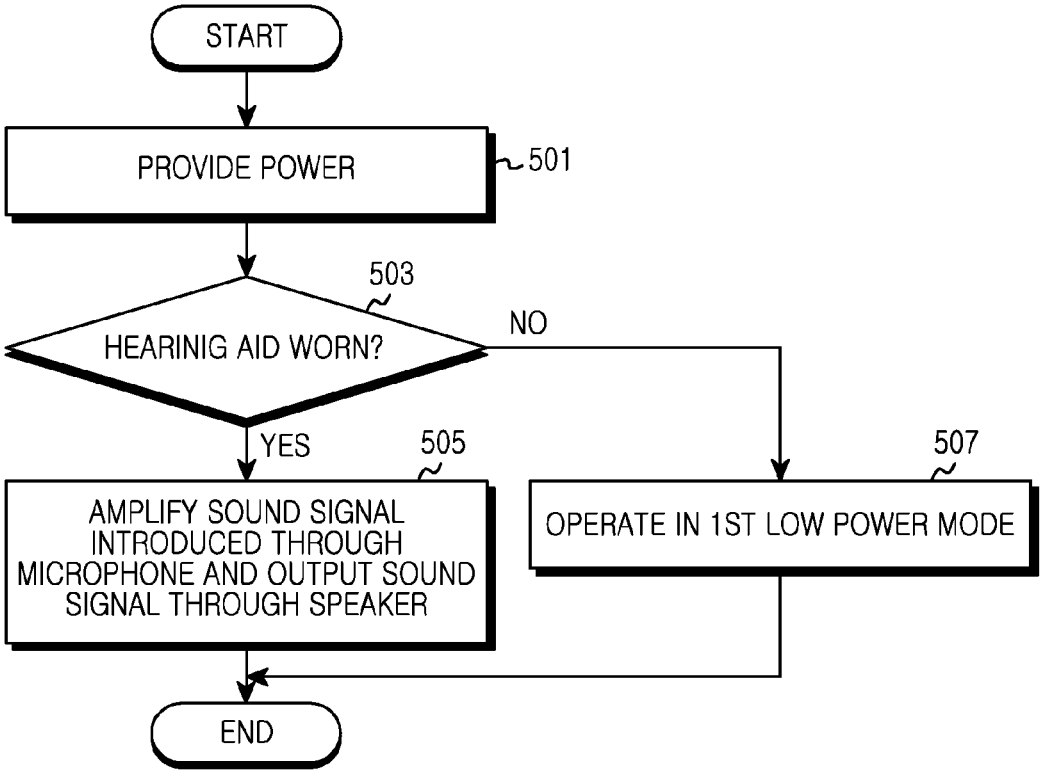
FIG. 5 is a flowchart for operating in a low power mode of a hearing aid according to an embodiment of the present disclosure.

FIG. 5 is a flowchart for operating in a low power mode of a hearing aid according to an embodiment of the present disclosure.

Referring to FIG. 5, at operation 501, the hearing aid checks if a power source is applied. For example, the hearing aid can check if a battery is inserted.

At operation 503, the hearing aid determines whether the hearing aid is worn by a user. For example, the hearing aid 200 can check whether the hearing aid 200 is worn by the user using the release sensing module 240.

If the hearing aid is worn by the user at operation 503, at operation 505, the hearing aid can operate in a normal mode and amplify a sound signal received through the microphone 250 to output the amplified sound signal through the speaker 260. For example, the hearing aid 200 can convert a sound signal received through the microphone 250 into a digital sound signal, perform digital signal processing (e.g., noise removal, amplification gain, and non-linear amplification, etc.) for the digital sound signal, and amplify the digital sound signal.

If the hearing aid is not worn by the user at operation 503, at operation 507, the hearing aid can convert into a first low power mode and operate in the first low power mode. For example, if operating in the first low power mode, the hearing aid can activate only the release sensing module 240. For instance, if operating in the first low power mode, the hearing aid can deactivate the processor 220, the memory 230, the microphone 250, and the speaker 260.

Figure 6:
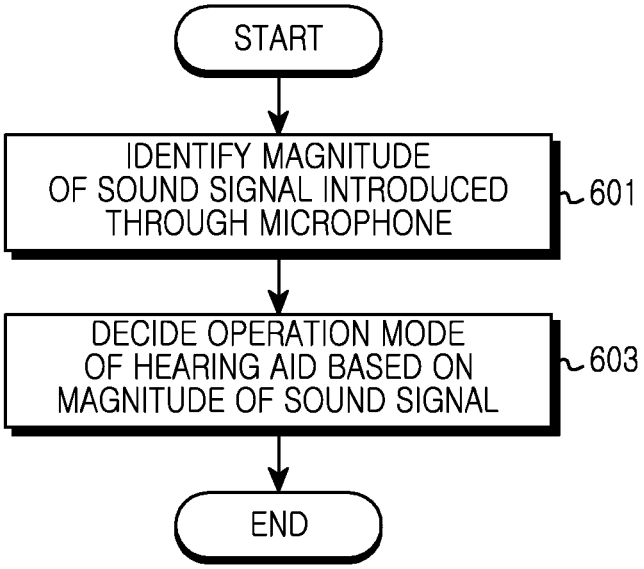
FIG. 6 is a flowchart for deciding an operation mode based on a magnitude of a sound signal received through a microphone in a hearing aid according to an embodiment of the present disclosure.

FIG. 6 is a flowchart for deciding an operation mode based on a magnitude of a sound signal received through a microphone in a hearing aid according to an embodiment of the present disclosure.

Referring to FIG. 6, if the hearing aid operates in a normal mode, at operation 601, the hearing aid identifies a magnitude (e.g., a magnitude of an input sound pressure) of a sound signal received through a microphone. For example, referring to FIG. 1A, the hearing aid 100 can identify a magnitude of a sound signal received through any one microphone among the first microphone 112 and the second microphone 114. For another example, referring to FIG. 1A, the hearing aid 100 can identify an average magnitude of sound signals received through the first microphone 112 and the second microphone 114. For further example, referring to FIG. 1B, the hearing aid 100 can identify a magnitude of a sound signal received through any one microphone among the first microphone 112, the second microphone 114, and a third microphone 118. For yet another example, referring to FIG. 1B, the hearing aid 100 can identify an average magnitude of sound signals received through at least two microphones among the first microphone 112, the second microphone 114, and the third microphone 118.

At operation 603, the hearing aid decides an operation mode of the hearing aid based on the magnitude of the sound signal received through the microphone. For example, if the magnitude of the sound signal received through the microphone is less than a reference magnitude, the hearing aid can decide the operation mode of the hearing aid as a low power mode.

Figure 7:
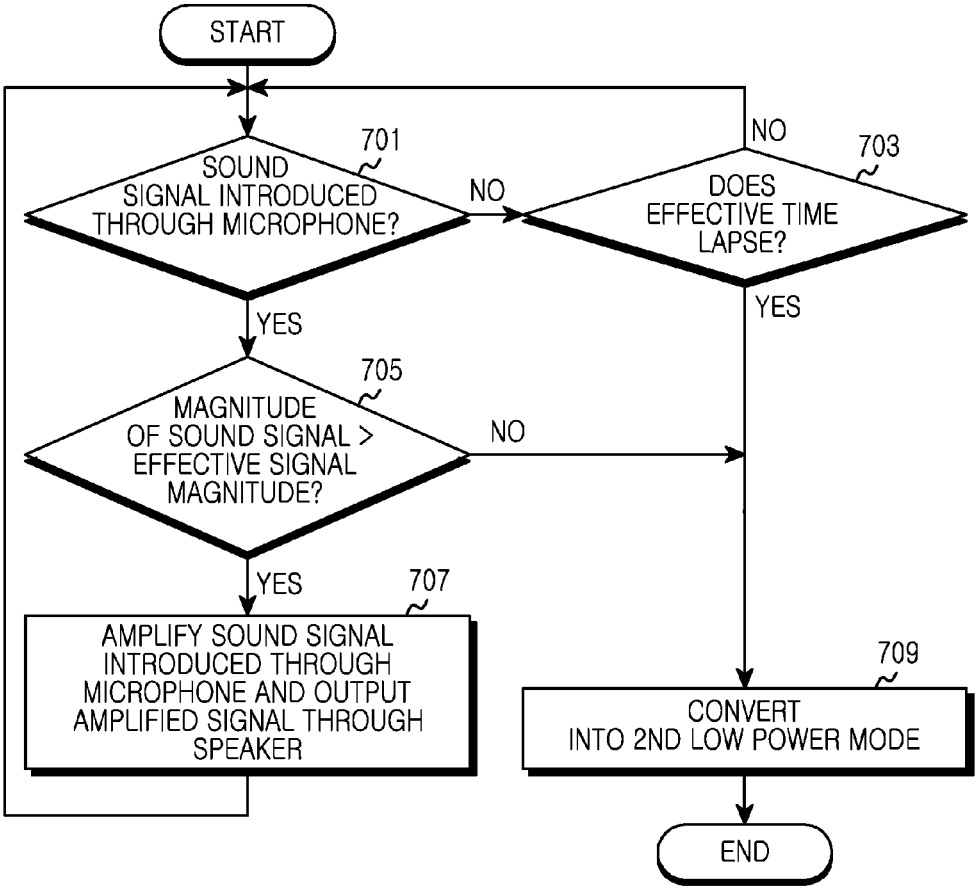
FIG. 7 is a flowchart for operating in a low power mode based on a magnitude of a sound signal received through a microphone in a hearing aid according to an embodiment of the present disclosure.

FIG. 7 illustrates is a flowchart for operating in a low power mode based on a magnitude of a sound signal received through a microphone in a hearing aid according to an embodiment of the present disclosure.

Referring to FIG. 7, if the hearing aid operates in a normal mode, at operation 701, the hearing aid checks if a sound signal is received from a microphone.

If the sound signal is not received through the microphone at operation 701, at operation 703, the hearing aid can check if an effective time lapses from the last time point at which the sound signal is received through the microphone.

If the effective time does not lapse at operation 703, the hearing aid returns to operation 701 and checks if a sound signal is received through the microphone.

If the effective time lapses at operation 703, at operation 709, the hearing aid converts into a second low power mode.

If the sound signal is received through the microphone at operation 701, at operation 705, the hearing aid checks if a magnitude (e.g., a magnitude of an input sound pressure) of the received sound signal is greater than an effective signal magnitude. For example, referring to FIG. 1A, the hearing aid 100 can check if a magnitude of a sound signal received through any one microphone among a first microphone 112 and a second microphone 114 is greater than an effective signal magnitude. For another example, referring to FIG. 1A, the hearing aid 100 can check if an average magnitude of sound signals received through the first microphone 112 and the second microphone 114 is greater than the effective signal magnitude. For further example, referring to FIG. 1B, the hearing aid 100 can check if a magnitude of a sound signal received through any one microphone among the first microphone 112, the second microphone 114, and a third microphone 118 is greater than the effective signal magnitude. For yet another example, referring to FIG. 1B, the hearing aid 100 can check if an average magnitude of sound signals received through at least two microphones among the first microphone 112, the second microphone 114, and the third microphone 118 is greater than the effective signal magnitude.

If the magnitude of the sound signal received through the microphone is greater than the effective signal magnitude at operation 705, at operation 707, the hearing aid can operate in the normal mode, and amplify the sound signal received through the microphone 250 and output the amplified sound signal through the speaker 260.

If the magnitude of the sound signal received through the microphone is less than or is equal to the effective signal magnitude at operation 705, at operation 709, the hearing aid can convert into the second low power mode and operate in the second low power mode. For example, if the hearing aid operates in the second low power mode, the hearing aid can activate the processor 220, the microphone 250, and the release sensing module 240.

Figure 8:
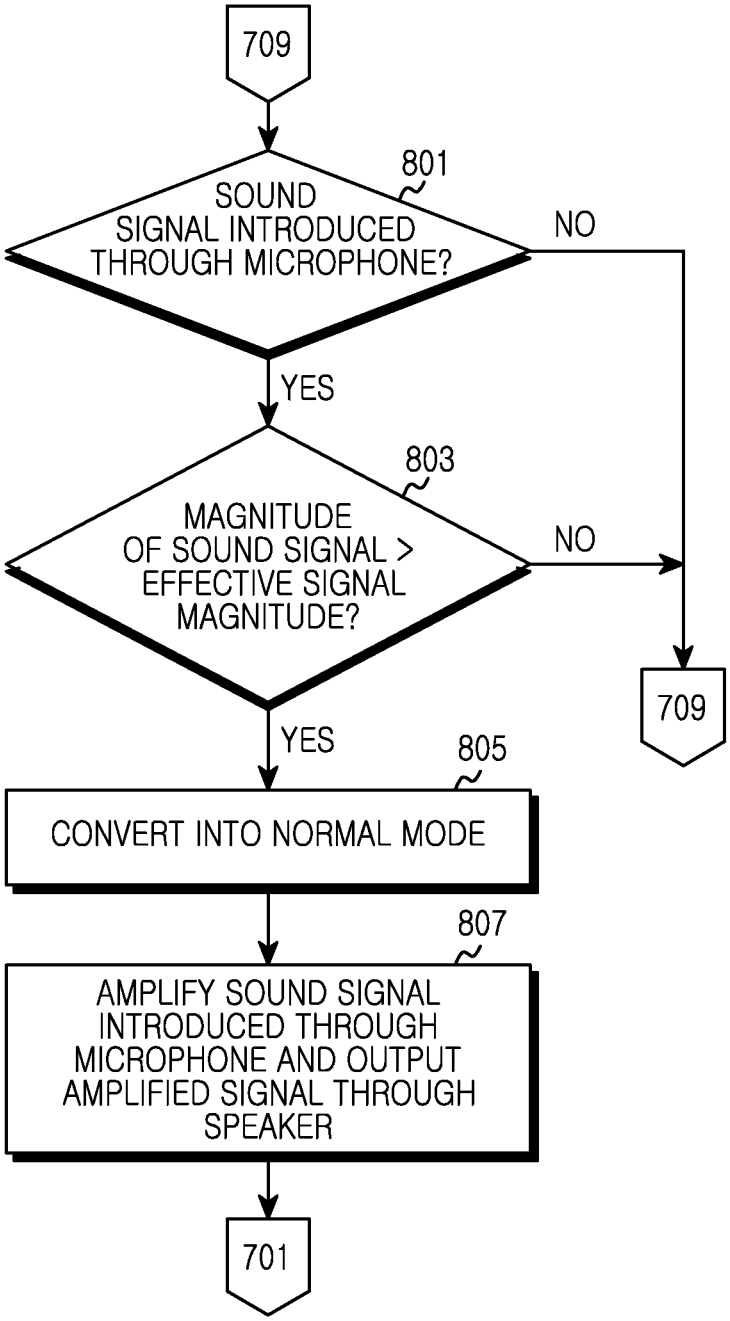
FIG. 8 is a flowchart for converting into an activation mode based on a magnitude of a sound signal received through a microphone in a hearing aid according to an embodiment of the present disclosure.

FIG. 8 is a flowchart for converting into an activation mode based on a magnitude of a sound signal received through a microphone in a hearing aid according to an embodiment of the present disclosure.

Referring to FIG. 8, if the hearing aid operates in the second low power mode at operation 709 of FIG. 7, at operation 801, the hearing aid checks if a sound signal is received through a microphone.

If the sound signal is not received through the microphone at operation 801, at operation 709, the hearing aid can maintain an operation of the second low power mode.

If the sound signal is received through the microphone at operation 801, at operation 803, the hearing aid checks if a magnitude (e.g., a magnitude of an input sound pressure) of the received sound signal is greater than an effective signal magnitude. For example, the hearing aid can check if an average magnitude of a sound signal received through at least one microphone among a first microphone 112, a second microphone 114, and a third microphone 118 is greater than the effective signal magnitude.

If the magnitude of the sound signal received through the microphone is less than or is equal to the effective signal magnitude at operation 803, at operation 709, the hearing aid can maintain the operation of the second low power mode.

If the magnitude of the sound signal received through the microphone is greater than the effective signal magnitude at operation 803, at operation 805, the hearing aid can convert into a normal mode. For example, the hearing aid can activate the memory 230 and the speaker 260 that were previously deactivated in the second low power mode.

At operation 807, the hearing aid can amplify the sound signal received through the microphone 250 and output the amplified sound signal through the speaker 260.

In the aforementioned embodiment of the present disclosure, the hearing aid can recognize the first low power mode and the second low power mode as different operation modes and operate in the different operation modes.

In another embodiment of the present disclosure, the hearing aid can recognize the first low power mode and the second low power mode as the same operation mode and operate in the same operation mode. For example, if recognizing the first low power mode and the second low power mode as the same operation mode, when operating in the first low power mode and the second low power mode, the hearing aid can activate the processor 220, the microphone 250, and the release sensing module 240.

As described above, the hearing aid converts into a low power mode based on when a user wears a hearing aid and a magnitude of a sound signal received through a microphone, thereby being able to reduce unnecessary power consumption and increase a time of use of the hearing aid.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A method for managing an operation mode of a hearing aid, the method comprising the processes of:

acquiring a first input sound pressure of a first microphone which is located at a first surface that contacts a user when the hearing aid is worn by the user;

acquiring a second input sound pressure of a second microphone which is located at a second surface that does not contact the user when the hearing aid is worn by the user;

determining whether the hearing aid is worn by a user by comparing a magnitude of the first input sound pressure with a magnitude of the second input sound pressure;

in response to the determining that the hearing aid is not worn by the user, operating the hearing aid in a first low power mode; and determining, in response to the determining that the hearing aid is worn by the user, an operation mode of the hearing aid based on the magnitude of at least one of the first input sound pressure of the first microphone or the second input sound pressure of the second microphone, wherein the determining of the operation mode of the hearing aid comprises, operating, if the magnitude of the at least one of the first input sound pressure of the first microphone or the second input sound pressure of the second microphone is less than a reference magnitude, the hearing aid in a second low power mode different from the first low power mode.

2. The method of claim 1, wherein the determining of the operation mode comprises determining the operation mode based on an average magnitude of the first input sound pressure of the first microphone and the second input sound pressure of the second microphone.

3. A method for managing an operation mode of a hearing aid, the method comprising the processes of:

acquiring a first input sound pressure of a first microphone which is located at a first surface that contacts a user when the hearing aid is worn by the user;

acquiring a second input sound pressure of a second microphone which is located at a second surface that does not contact the user when the hearing aid is worn by the user;

determining whether the hearing aid is being worn by a user by comparing a magnitude of the first input sound pressure with a magnitude of the second input sound pressure; and determining an operation mode of the hearing aid based on the determination that the hearing aid is being worn by the user.

4. The method of claim 3, wherein the determining of the operation mode comprises, if the hearing aid is not being worn by the user, determining the operation mode of the hearing aid as a low power mode.

5. A hearing aid apparatus comprising:

a first microphone;

a second microphone;

a speaker; and at least one processor configured to:

acquire a first input sound pressure of the first microphone which is located at a first surface that contacts a user when the hearing aid is worn by the user, acquire a second input sound pressure of the second microphone which is located at a second surface that does not contact the user when the hearing aid is worn by the user, determine whether the hearing aid is being worn by a user by comparing a magnitude of the first input sound pressure with a magnitude of the second input sound pressure, operate, in response to the determining that the hearing aid is not being worn by the user, the hearing aid in a first low power mode, and determine, in response to the determining that the hearing aid is being worn by the user, an operation mode of the hearing aid based on the magnitude of at least one of the first input sound pressure of the first microphone or the second input sound pressure of the second microphone, wherein the processor is further configured to operate, if the magnitude of the at least one of the first input sound pressure of the first microphone or the second input sound pressure of the second microphone is less than a reference magnitude, the hearing aid in a second low power mode different from the first low power mode.

6. The apparatus of claim 5, wherein the at least one processor is further configured to determine the operation mode of the hearing aid based on an average magnitude of the first input sound pressure of the first microphone and the second input sound pressure of the second microphone.

7. The apparatus of claim 5, wherein, the at least one processor is further configured to, if the hearing aid operates in a normal mode:

amplify a sound signal received through the second microphone based on a preset amplification gain, and output the amplified sound signal through the speaker.

8. A hearing aid apparatus comprising:

a first microphone;

a second microphone;

a speaker; and at least one processor configured to:

acquire a first input sound pressure of the first microphone which is located at a first surface that contacts a user when the hearing aid is worn by the user, acquire a second input sound pressure of the second microphone which is located at a second surface that does not contact the user when the hearing aid is worn by the user, determine whether the hearing aid is being worn by the user by comparing a magnitude of the first input sound pressure with a magnitude of the second input sound pressure, and determine an operation mode of the hearing aid based on the determination that the hearing aid is being worn by the user.

9. The apparatus of claim 8, wherein the at least one processor is further configured to:

control the hearing aid to operate in a low power mode if the hearing aid is not being worn by the user, and control the hearing aid to operate in a normal mode if the hearing aid is being worn by the user.

10. The apparatus of claim 9, wherein the at least one processor is further configured to, if the hearing aid operates in the normal mode:

amplify a sound signal received through the second microphone based on a preset amplification gain, and output the amplified sound signal through the speaker.

* * * * *